US010228100B2

(12) United States Patent
Magielse et al.

(10) Patent No.: US 10,228,100 B2
(45) Date of Patent: Mar. 12, 2019

(54) LIGHTING DEVICE AND LIGHTING SYSTEM

(71) Applicant: PHILIPS LIGHTING HOLDING B.V., Eindhoven (NL)

(72) Inventors: Remco Magielse, Eindhoven (NL); Andreas Adrianus Jozef Van Dijk, Eindhoven (NL); Joris Hubertus Antonius Hagelaar, Eindhoven (NL); Niels Van Tetrode, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/778,717

(22) PCT Filed: Nov. 21, 2016

(86) PCT No.: PCT/EP2016/078321
§ 371 (c)(1),
(2) Date: May 24, 2018

(87) PCT Pub. No.: WO2017/093063
PCT Pub. Date: Jun. 8, 2017

(65) Prior Publication Data

US 2018/0356055 A1 Dec. 13, 2018

(30) Foreign Application Priority Data

Dec. 1, 2015 (EP) ..... 15197169

(51) Int. Cl.

| | |
|---|---|
| ***F21S 4/28*** | (2016.01) |
| ***F21V 21/24*** | (2006.01) |
| ***F21V 21/26*** | (2006.01) |
| ***F21V 21/28*** | (2006.01) |
| ***F21V 21/29*** | (2006.01) |
| ***F21V 21/30*** | (2006.01) |

(Continued)

(52) U.S. Cl.
CPC ..... *F21S 4/28* (2016.01); *F21V 23/06* (2013.01); *F21V 21/24* (2013.01); *F21V 21/26* (2013.01);

(Continued)

(58) Field of Classification Search
CPC ..... F21V 21/24; F21V 21/26; F21V 21/28; F21V 21/29; F21V 21/30; F21V 23/06
See application file for complete search history.

(56) References Cited

U.S. PATENT DOCUMENTS 2,204,301 A * 6/1940 Carwardine ..... F21V 21/24 248/586
5,709,461 A 1/1998 Michl et al.
(Continued)

FOREIGN PATENT DOCUMENTS

JP 2011065873 A 3/2011
JP 2011090887 A 5/2011

*Primary Examiner* — Alexander K Garlen
*Assistant Examiner* — Colin J Cattanach
(74) *Attorney, Agent, or Firm* — Akarsh P. Belagodu

(57) ABSTRACT

A lighting device (10) is disclosed comprising a flexible arrangement including a chain of strips (11) wherein respective end portions of neighboring strips (11) are interconnected by a hinging joint (13) and a plurality of LEDs (15) positioned at regular intervals along the flexible arrangement. The pitch of the LEDs (15) in such a lighting device (10) may be adjusted by adjusting the angle between neighboring strips (11) interconnected by a hinging joint (13). A lighting system (100) comprising such lighting devices (10) and a central controller (110) is also disclosed.

15 Claims, 6 Drawing Sheets

(51) Int. Cl.

| | |
|---|---|
| ***F21V 23/06*** | (2006.01) |
| ***F21Y 101/00*** | (2016.01) |
| ***F21Y 103/10*** | (2016.01) |
| ***F21Y 113/10*** | (2016.01) |
| ***F21Y 115/10*** | (2016.01) |

(52) U.S. Cl.

CPC ..... *F21V 21/28* (2013.01); *F21V 21/29* (2013.01); *F21V 21/30* (2013.01); *F21Y 2101/00* (2013.01); *F21Y 2103/10* (2016.08); *F21Y 2113/10* (2016.08); *F21Y 2115/10* (2016.08)

(56) References Cited

U.S. PATENT DOCUMENTS 6,299,330 B1 * 10/2001 Michl ..... F21V 1/08 362/239
7,918,702 B2 4/2011 Weekamp
8,393,755 B2 * 3/2013 Chien ..... F21S 9/02 362/238
8,696,162 B2 * 4/2014 Wendt ..... E04B 9/006 362/249.03
9,316,350 B2 * 4/2016 Matsuoka ..... F16M 13/022
2002/0177092 A1 11/2002 Latzel
2008/0259632 A1 * 10/2008 Chien ..... H04N 5/2354 362/565
2010/0238663 A1 * 9/2010 Chen ..... G09F 9/33 362/249.03
2011/0109235 A1 5/2011 Link
2012/0033426 A1 * 2/2012 Wendt ..... E04B 9/006 362/249.03
2012/0127708 A1 * 5/2012 Chien ..... F21V 17/02 362/234
2014/0313721 A1 10/2014 Morgan
2014/0318721 A1 * 10/2014 Pedersen ..... E05B 65/0014 160/210
2015/0117005 A1 * 4/2015 Zanotto ..... F21V 21/26 362/249.1

* cited by examiner

10

10

LIGHTING DEVICE AND LIGHTING SYSTEM

CROSS-REFERENCE TO PRIOR APPLICATIONS

This application is the U.S. National Phase application under 35 U.S.C. § 371 of International Application No. PCT/EP2016/078321, filed on Nov. 21, 2016, which claims the benefit of European Patent Application No. 15197169.4, filed on Dec. 1, 2015. These applications are hereby incorporated by reference herein.

FIELD OF THE INVENTION

The present invention relates to a lighting device comprising a plurality of point light sources such as LEDs at regular intervals.

The present invention further relates to a lighting system comprising a plurality of such lighting devices.

BACKGROUND OF THE INVENTION

Lighting using point light sources such as LED lighting is rapidly gaining popularity because of its long lifetime and low power consumption. In addition, due to the configurability of LED lighting, such lighting is routinely integrated in lighting systems that deliver configurable lighting to an environment in which the lighting system is installed. Such lighting systems may include lighting systems in which a plurality of different light sources are interconnected using wireless or wired communication technologies.

An example of LED lighting for use in such lighting systems is LED lighting strips, in which the LEDs are typically distributed along a strip at regular distances from each other, which regular distance is commonly referred to as the pitch of the LEDs. As such LED lighting may be used in a wide variety of environments having different lighting requirements, different LED lighting strips may require LEDs at different pitches in order to deliver the required lighting requirement. Consequently, different LED lighting strips need to be manufactured for such different requirements, which is costly to the manufacturer of such LED lighting and lighting systems including such LED lighting.

US 2011/0109235 A1 discloses an expandable and controllable LED lighting strip in the form of a transparent long strip having a plurality of LEDs. The strip includes a flexible printed circuit board with the LEDs spaced thereon by a predetermined distance. The circuit board is coated with a transparent waterproof protective layer and has a male and a female connector provided to two ends thereof, allowing two or more pieces of the LED lighting strips to serially connect end to end. A control chip is packaged on a reverse side of the circuit board for controlling the LEDs on the same circuit board to operate. The LED light strips can be wound into rolls for storage, and can be serially or parallelly connected to one another to form an LED matrix. However, such a lighting strip still relies on a fixed pitch between LEDs.

US-2014/0313721 discloses an electric lighting arrangement including a plurality of lighting units each containing a plurality of LED lights, to form a strip of lights. The units are adapted to be joined together by means of a ball joint arrangement, which comprises two conjoined balls, each ball being adapted to be mounted in a retaining bail cup in a lighting unit, ball cups being provided on opposed ends of the units to enable the units to be pivotable one relative to the other in all planes.

US-2015/0117005 discloses a light fixture that includes a plurality of elongate members, each extending between opposed ends and carrying one or more LEDs, and at least one hinge member which mechanically couples one end of one of the elongate members to one end of another of the elongate members. The hinge member allows the orientation of the elongate members between an open position, wherein the elongate members extend in sequence with each other in a common direction, and a closed position, wherein the elongate members extend side by side.

SUMMARY OF THE INVENTION

The present invention seeks to provide a lighting device for which the pitch of the lighting device is adjustable.

The present invention further seeks to provide a lighting system including such lighting devices.

According to an aspect, there is provided a lighting device comprising a flexible arrangement including a chain of strips wherein respective end portions of neighboring strips are interconnected by a hinging joint; and a plurality of point light sources positioned at regular intervals along the flexible arrangement. The flexible arrangement comprises at least one elastic member for retaining the flexible arrangement in an equilibrium configuration in the absence of a stretching or compression force applied to the flexible arrangement.

By positioning the point light sources, e.g. LEDs on strips that are interconnected by flexible joins such as hinging joints, the pitch of the point light sources can be adjusted by controlling the angles between neighbouring strips, i.e. by compressing or stretching the strip. In this manner, the lighting device can be configured for different uses, thus avoiding the need to provide separate lighting devices for applications in which the pitch of the point light sources should be different. The use of hinging joints is preferred where the joints are to provide structural integrity to the lighting device, i.e. retain a defined orientation between neighboring strips. However, where such structural integrity is provided by other features as will be explained below, the flexible join may simply be a non-retaining member such as a flexible (conductive) wire.

At least some of the point light sources may be positioned on the hinging joints, which for instance facilitates providing a power supply to the point light sources in case the hinging joints are electrically conductive.

In a preferred embodiment, the flexible arrangement further comprises a further chain of strips in which respective end portions of neighboring strips are interconnected by a flexible join such as a hinging joint, wherein at least some of the strips of the further chain are joined to a strip of the chain by a further flexible join such as a further hinging joint in between the respective end portions of said strips. In this manner, a pantograph-style lighting device may be provided, which facilitates excellent control over the pitch of the LEDs on the flexible arrangement. In order to provide the flexible arrangement with more structural stability, the chain may interleave the further chain.

Preferably, each further hinging joint is located in a central region of said strips to facilitate such control.

At least some of the point light sources may be positioned on the further hinging joints, which facilitates excellent control over the pitch of the point light sources and provides an appearance in which the point light sources appear to be positioned in a single line, thereby mimicking a strip-shaped lighting device. Alternatively or additionally, at least some of the point light sources are positioned on the hinging joints, for example in applications where a higher luminous output than achievable by point light sources on the further hinging joints (only) is required. The point light sources may be positioned on an alternating pattern of hinging joints to control the uniformity of the lighting produced by the point light sources.

In an embodiment, the point light sources may be located opposite sides of the lighting device, i.e. on opposite sides of the one or more chains of the lighting device, to provide a lighting device that can generate light in multiple directions.

To facilitate the requirement that the flexible arrangement returns to or retains its original position, i.e. its equilibrium position, if no stretching or compression force is applied to the flexible arrangement, i.e. the flexible arrangement is not pulled apart or pushed together, the flexible arrangement comprises at least one elastic member for retaining the flexible arrangement in an equilibrium configuration in the absence of a stretching or compression force applied to the flexible arrangement.

In an embodiment, the at least one elastic member comprises a plurality of springs interconnecting central regions of neighboring strips, which bring the flexible arrangement back to its equilibrium position by pulling neighbouring strips back to their original orientation relative to each other as dictated by the rest position of the springs.

In an alternative embodiment, the at least one elastic member comprises an elastic material onto which the flexible arrangement is mounted or into which the flexible arrangement is embedded. Such a material may at least to a certain extent return to its original geometry after having been stretched or compressed. The elastic material may be an elastic sheet covering the flexible arrangement and comprising a plurality of light exit structures, each light exit structure exposing one of the point light sources to hide the flexible arrangement to give the lighting device a more strip-like appearance. In this embodiment, the flexible joins may be embodied by flexible wires, e.g. flexible conductive wires, as the structural rigidity of the lighting device is provided by the elastic material.

The respective strips of the chain and if present the further chain may be printed circuit board strips that provide electrical current to the point light sources, e.g. LEDs positioned on hinging joints and/or further hinging joints.

The point light sources preferably are LEDs. At least some of the LEDs may be arranged to selectively generate white light or coloured light, e.g. by placement of a microchip in front of such LEDs, thereby facilitating the generation of multiple light effects with the lighting device.

In accordance with another aspect, there is provided a lighting system comprising a plurality of the lighting devices of any of the above embodiments and a central controller communicatively coupled to the plurality of lighting devices. Such a lighting system benefits from the fact that the plurality of lighting devices facilitates configuration of the lighting system in many different configurations that require different pitches of the point light sources such as LEDs in the respective lighting devices, thereby obviating the need to provide lighting devices having point light sources at pitches tuned to a particular application, which reduces the cost of the lighting system.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
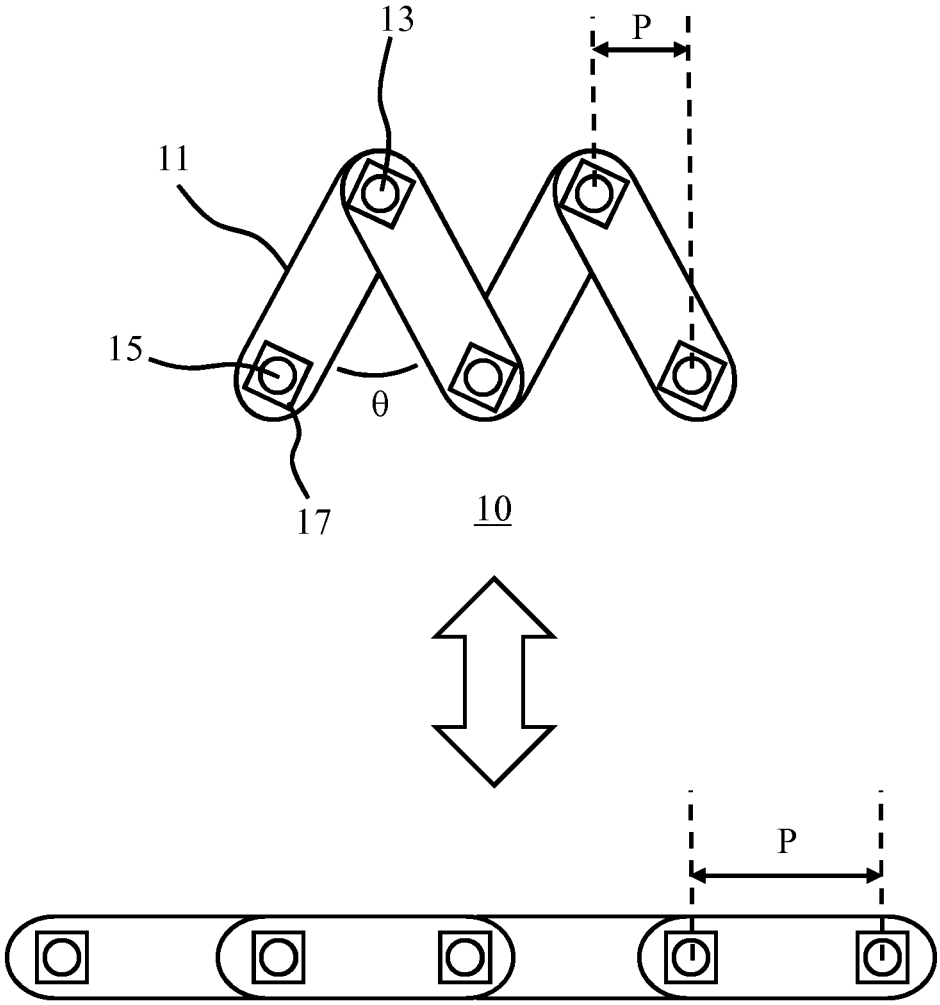
FIG. 1 schematically depicts a concertina-style flexible lighting device according to an embodiment.

It should be understood that the Figures are merely schematic and are not drawn to scale. It should also be understood that the same reference numerals are used throughout the Figures to indicate the same or similar parts.

FIG. 1 schematically depicts a lighting device 10 according to an embodiment. The lighting device 10 comprises a flexible arrangement in the form of a chain of strips 11 that are interconnected by hinging joints 13. In the context of the present application, a strip 11 is a chain member that is longer than that it is wide. The strips 11 may otherwise have any suitable shape, e.g. a rectangular shape, a rectangular shape with rounded end portions, a parallelogram shape, and so on.

In the context of the present application, a hinging joint is a joint that allows the angle θ between neighboring strips 11 to be adjusted, e.g. such that the angle θ may adopt any value within a given range, which range preferably contains the value of 180° as an endpoint or as an intermediate point. The hinging joints 13 are typically located at a terminal or end portion of each strip 11. In this manner, the overall length of the chain of strips 11 may be adjusted by varying the respective angles θ between interconnected neighboring strips 11.

In some embodiments, a hinging joint may be a joint that additionally allows an out-of-plane pending of part of the lighting device 10 attached to the lighting device 10, for example to allow to bend the lighting device 10 around corners or the like. A non-limiting example of such a hinging joint is a ball joint although other suitable examples will be immediately apparent to the skilled person.

Point light sources such as LEDs 15 are mounted at regular intervals at the flexible arrangement, here at the hinging joints 13 of the chain. In this embodiment, the hinging joints 13 may be electrically conductive to provide an electrical current to the LEDs 15. By way of non-limiting example, the hinging joints may be metal rivet joints although it should be understood that other suitable joints may also be considered, e.g. ball joints that allow out-of-plane bending of part of the lighting device 10 as explained above. The LEDs 15 may be any suitable type of LEDs, e.g. a LED package, a chip-on-board (COB) LED, and so on. In the context of the present application, where reference is made to a LED, it should be understood that this definition also includes embodiments in which a plurality of light emitting diodes are integrated into a single device, with the single device being referred to as a LED 15. In the remainder of the description, reference will be made to the point light sources as LEDs by way of non-limiting example; it should be understood that any suitable type of point light source, e.g. point light sources other than LEDs may be used for this purpose.

At least some of the LEDs 15 may be configured to selectively produce white light or colored light, for instance by the provision of a suitable microchip 17 over the LED 15. Such arrangements are well-known per se and are therefore not explained in further detail for the sake of brevity only. In an embodiment, the LEDs 15 may be individually addressable or grouped in a plurality of groups that are addressable at the group level such that different lighting effects may be generated with the lighting device 10 by addressing (enabling) different LEDs or different groups of LEDs and/or switching the addressed LEDs to different configurations, e.g. white light- or colored light-producing configurations.

The strips 11 may be made of any suitable material and typically are electrically conductive or at least contain electrically conductive tracks that facilitate the provision of an electrical current to the LEDs 15, for example via the electrically conductive hinging joints 13 in case the LEDs 15 are mounted on these hinging joints.

The lighting device 10 can be seen as a concertina-style lighting device in which the geometry of the lighting device 10 can be altered by pulling apart (or pressing together) the interconnected strips 11 as shown in FIG. 1, in which the lighting device 10 is preconfigured from a meandering or collapsed lighting device 10 at the top to a straight or at least extended lighting device 10 at the bottom, thereby increasing the pitch P between the LEDs 15 on the flexible arrangement, i.e. of the chain of strips 11. In this manner, the pitch P of the LEDs 15 in the lighting device 10 may be altered, i.e. tuned to a particular application by altering the respective angles θ between interconnected neighboring strips 11.

Figure 2:
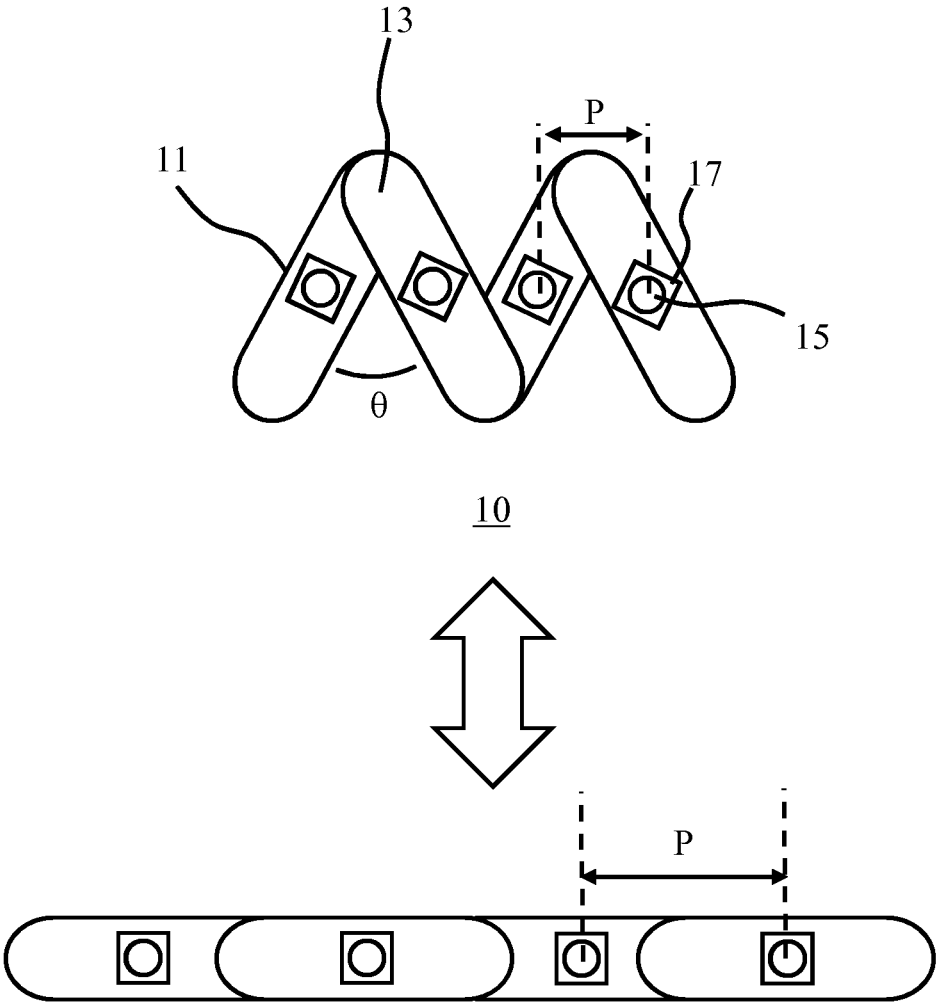
FIG. 2 schematically depicts a concertina-style flexible lighting device according to another embodiment.

FIG. 2 schematically depicts an alternative embodiment of the concertina-style lighting device 10 in which the LEDs 15 are positioned on intermediate sections of the strips 11, which intermediate sections are located in between the end portions of the strips 11 at which the hinging joints 13 are located. As before, microchips 17 may be positioned over selected LEDs 15, i.e. over some or all of the LEDs 15. Preferably, the LEDs 15 are positioned centrally on each strip 11 such that regardless of the configuration of the lighting device 10, i.e. the selected angles θ between interconnected neighboring strips 11, the LEDs 15 can be positioned in a straight line at which the pitch P between LEDs 15 may be varied as explained before. In this embodiment, the strips 11 for example may comprise electrically conductive landing pads or the like in the intermediate sections onto which the LEDs 15 may be positioned in order to provide the LEDs 15 with the electrical currents and/or control signals to drive the LEDs 15.

Figure 3:
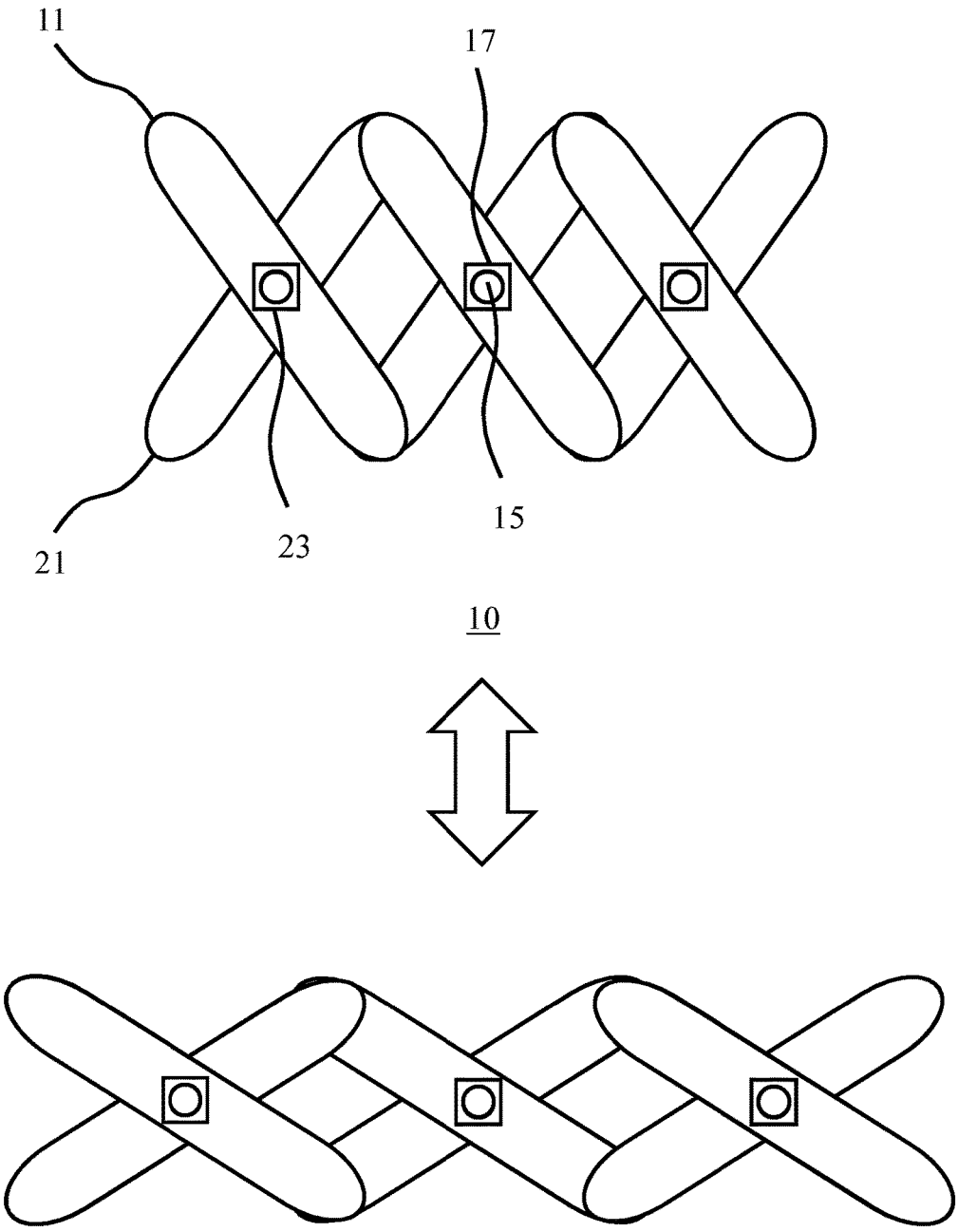
FIG. 3 schematically depicts a pantograph-style flexible lighting device according to an embodiment.

FIG. 3 schematically depicts another embodiment of the lighting device 10 in which the lighting device 10 is a pantograph-style lighting device having a flexible arrangement that comprises a first chain of strips 11 and a second chain of strips 21, which chains may be positioned on top of each other or may be interleaved to provide a lighting device 10 with reduced thickness compared to the embodiment in which the chains are positioned on top of each other. In this embodiment, at least some of the strips 11 and strips 21 are interconnected through further hinging joints 23 located in between the end portions of the strips 11 and the strips 21, e.g. in between hinging joints 13. Preferably, the further hinging joints 23 are located in the central regions of the strips 11 and the strips 21 such that interconnected strips 11 and strips 21 are centrally interconnected, e.g. by a further hinging joints 23 coinciding with a point or axis of symmetry of the strips 11 and strips 21.

The arrangement of the lighting device 10 in a lattice of interconnected strips reduces the degrees of freedom of the lighting device 10 but provides better control over the pitch P between the LEDs 15 positioned on the flexible arrangement. In particular, in the concertina-style lighting device 10 in FIGS. 1 and 2 each angle θ may be independently controlled, which makes it more difficult to ensure a uniform pitch P between the respective LEDs 15 of the lighting device 10, the pantograph-style lighting device 10 of FIG. 3 causes the interconnected segments of the flexible arrangement to alter geometry in a concerted manner, i.e. in the same manner, thereby ensuring that the pitch P of the LEDs 15 across the lighting device 10 can be varied without losing uniformity or regularity, e.g. by spreading the flexible arrangement from the top configuration to the bottom configuration shown in FIG. 3.

In FIG. 3, the LEDs 15 are positioned on the further hinging joints 23, which therefore preferably are electrically conducting, for example metal rivet joints although other suitable electrically conducting hinging joints will be immediately apparent to a skilled person and may be equally used. As explained before, by positioning the LEDs 15 at intermediate positions, e.g. central positions, of the strips 11, 21, the LEDs 15 may be arranged in a straight line regardless of the chosen configuration of the flexible arrangement of the lighting device 10.

Figure 4:
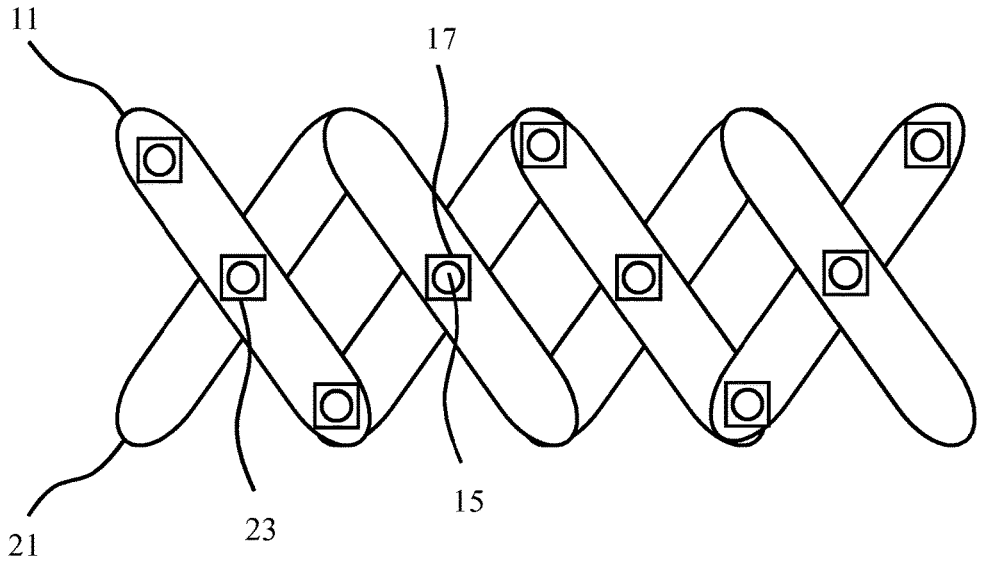
FIG. 4 schematically depicts a pantograph-style flexible lighting device according to another embodiment.

In order to increase the luminous output of the lighting device 10, LEDs 15 may be positioned on the hinging joints 13 as well as the further hinging joints 23. FIG. 4 schematically depicts an embodiment in which some of the hinging joints 13 carry LEDs 15 in addition to the further hinging joints 23. In FIG. 4, an alternating pattern of hinging joints 13 carries the additional LEDs 15. In the context of the present application, an alternating pattern of hinging joints 13 is intended to mean that strips 11, 21 oriented in the same direction alternately carry LEDs 15 on their hinging joints 13. In this embodiment, the illumination pattern generated by the lighting device 10 is still strip-like in nature, i.e. a meandering pattern of LEDs 15.

Figure 5:
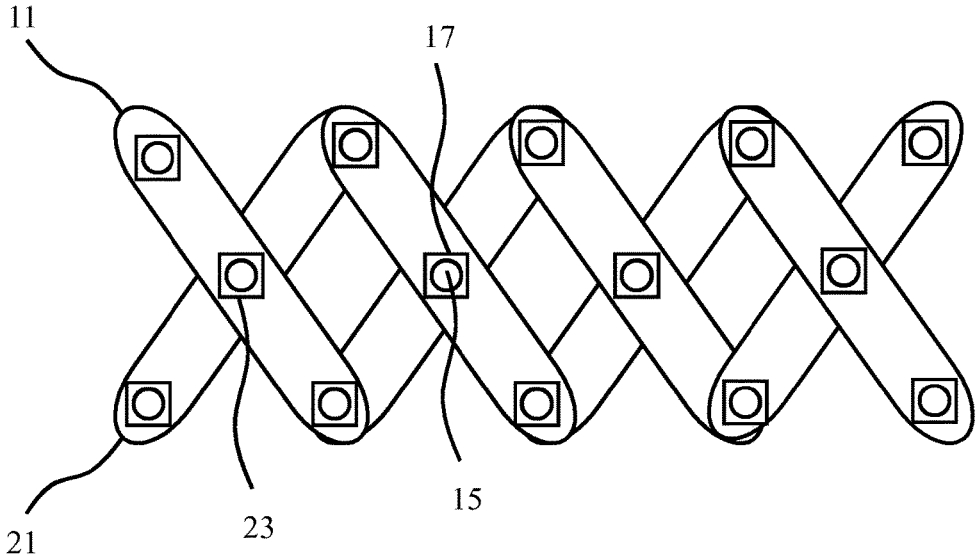
FIG. 5 schematically depicts a pantograph-style flexible lighting device according to yet another embodiment.

The luminous output of the lighting device 10 may be further increased by positioning LEDs on all the hinging joints 13 as schematically depicted in FIG. 5. This increased luminous output comes at the expense of the lighting device 10 sacrificing a strip-like luminous appearance; rather, in this embodiment the luminous appearance of the lighting device 10 may be characterised as comprising three rows of LEDs 15, i.e. on the upper and lower hinging joints 13 and on the intermediate further hinging joints 23. Other embodiments, e.g. in which at least some of the LEDs 15 are positioned on a strip 11 and/or a strip 21 in a location in between a hinging joint 13 and a further hinging joint 23 may also be contemplated.

Figure 6:
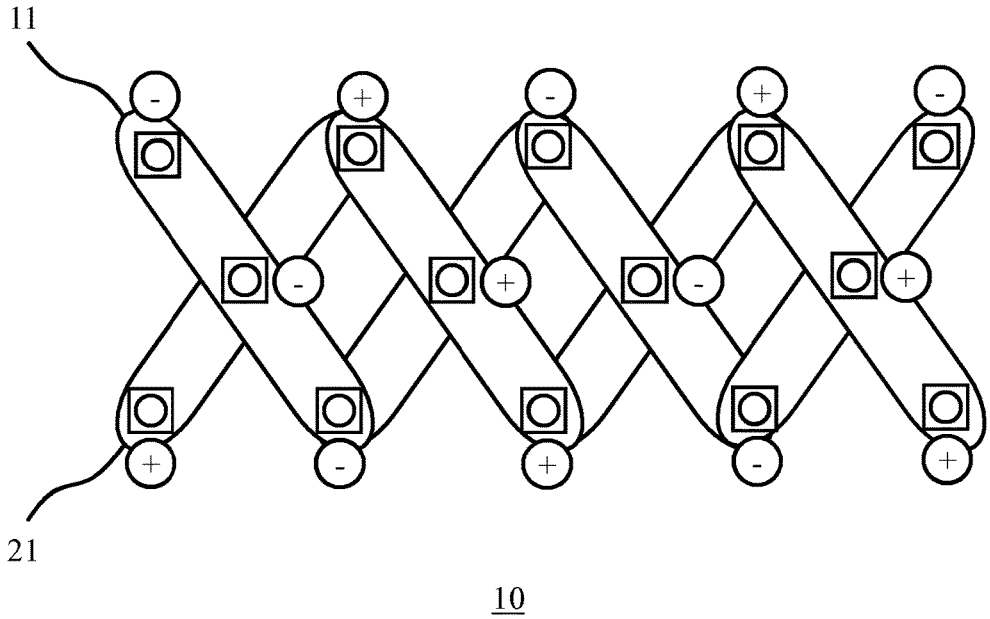
FIG. 6 schematically depicts an example electrical connectivity scheme for a pantograph-style flexible lighting device according to embodiments of the present invention.

FIG. 6 schematically depicts an example electrical layout for a lighting device 10 in which the polarity at the various hinging joints 13 and further hinging joints 23 may be alternated as indicated by the circled '+' and '−' signs in order to provide the respective LEDs 15 on the flexible arrangement with the appropriate electrical currents. It should be understood that this electrical layout is a mere example and that other suitable electrical layouts will be immediately apparent to the skilled person.

In some embodiments, it may be desirable that the flexible arrangement of the lighting device 10 has an equilibrium position, that is, a position that the flexible arrangement returns to in the absence of an external force such as a stretching force or a compression force for altering the respective angles θ, i.e. the geometry, of the flexible arrangement being applied to the flexible arrangement. In other words, the lighting device 10 may include one or more elastic members that return the flexible arrangement to its rest or equilibrium position once the applied force to forcibly change the geometry of the flexible arrangement is no longer present (assuming that the flexible arrangement is not retained in its non-equilibrium jointly by fixing means such as screws, nails or the like). The ability to return the flexible arrangement of the lighting device 10 back to its original or equilibrium geometry is for instance advantageous where the lighting device 10 is to be used in different applications, which may require multiple readjustments of the pitch P of the LEDs 15.

Figure 7:
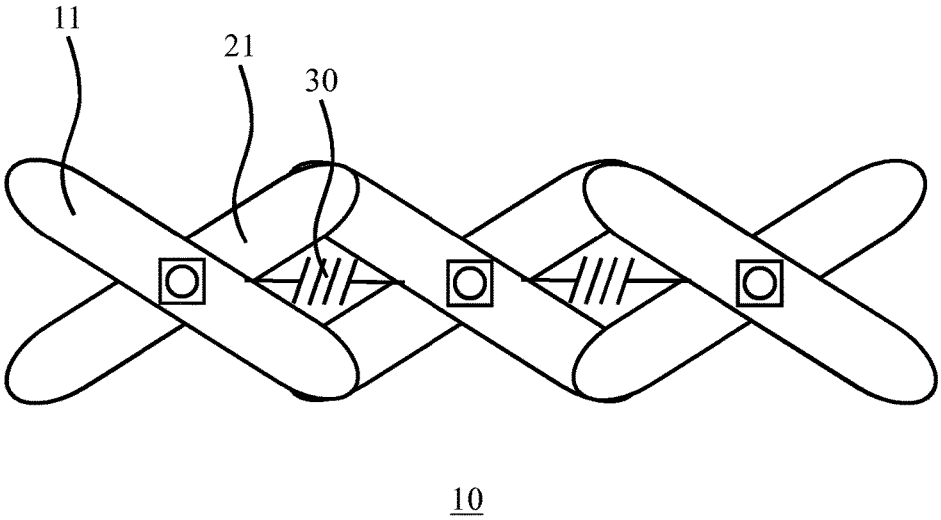
FIG. 7 schematically depicts a flexible lighting device according to a further embodiment.

FIG. 7 schematically depicts an embodiment in which the lighting device 10 comprises a plurality of springs 30 interconnecting neighboring central regions of the interconnected strips 11, 21. Each central region for instance may comprise a pair of apertures adjacent to the further hinging joints 23 for receiving a fixing member such as a hook of the spring 30 in order to secure the springs to the respective central regions. Many other suitable ways of fixing the springs 30 to the respective central regions of the strips 11, 21 will be immediately apparent to the skilled person. Upon stretching or compressing the lighting device 10, energy will be stored in the springs 30, which energy will be released as soon as the stretching or compression force is no longer applied to the lighting device 10, which release of energy causes the lighting device 10 to return back to its original (equilibrium) geometry. In this embodiment, in order to retain the lighting device 10 in its non-equilibrium geometry, the lighting device 10 would have to be fixed to a surface or the like, e.g. using a suitable fixing means.

Figure 8:
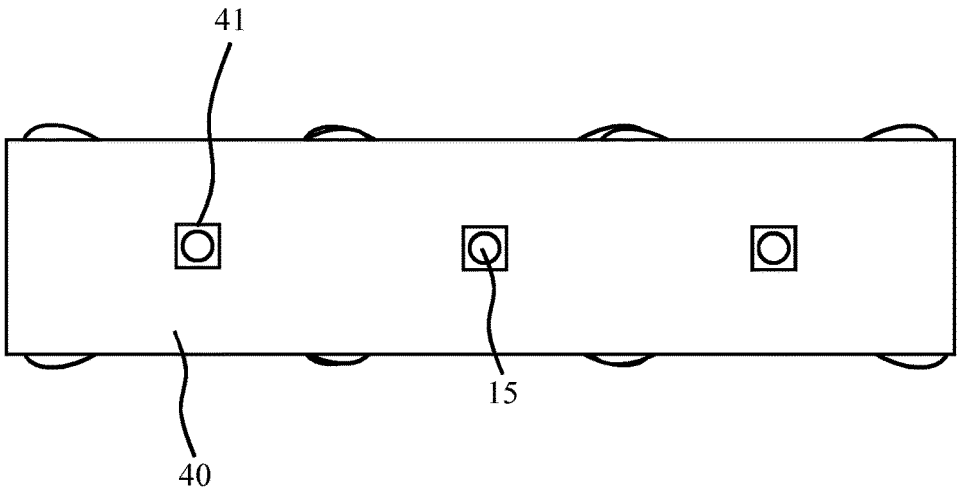
FIG. 8 schematically depicts a flexible lighting device according to still a further embodiment.

FIG. 8 schematically depicts an alternative embodiment in which the lighting device 10 is mounted on a stretchable sheet material 40, e.g. a stretchable polymer or any other suitable stretchable material such as a stretchable fabric. In this embodiment, the stretchable sheet material 40 preferably covers at least the flexible arrangement of the lighting device 10, in which case the stretchable sheet material 40 comprises a plurality of light exit structures 41 through which the LEDs 15 are exposed. In some embodiments, the light exit structures 41 simply may be holes although in other embodiments the light exit structures 41 may be optical elements, e.g. collimators or lenses. In this manner, a particularly aesthetically pleasing lighting device 10 may be provided in which the flexible arrangement is hidden from view. In some embodiments, the stretchable sheet material 40 may be decorated, e.g. comprise a decorative pattern, to further enhance the aesthetic appearance of the lighting device 10. The stretchable sheet material 40 ensures that the flexible arrangement can return to its equilibrium geometry or at least better retains a particular geometry.

Although not specifically shown, in an alternative embodiment the lighting device 10 may be embedded in a transparent or translucent flexible material such as a transparent flexible polymer. A non-limiting examples of such a transparent or translucent flexible polymer is a polysilicone, which is particularly suitable polymer due to its suitable thermal properties and ease of handling. By embedding the lighting device 10 in such a transparent or translucent flexible material, the geometry of its flexible arrangement may still be altered whilst the flexible material protects the lighting device 10 from accidental damage. In addition, such a flexible material may diffuse the luminous output of the lighting device 10, which may give the lighting device 10 an improved aesthetic appearance.

In an embodiment, where the lighting device 10 is mounted on a stretchable sheet material 40 or embedded in a transparent or translucent flexible material, the flexible joins in between neighboring strips 11 may be flexible (conductive) wires as in this embodiment the structural integrity otherwise provided by a hinging joint is instead provided by the stretchable sheet material 40 or the transparent or translucent flexible material.

In the above embodiments, the point light sources 15 are located on a single side or major surface of the one or more chains of the light device 10 by way of non-limiting example. It should be understood that it is equally feasible to have at least some of the point light sources 15, e.g. at least some LEDs, positioned on the opposite side or major surface of at least some of the one or more chains of the lighting device 10 in order to provide a lighting device that can produce light in multiple directions.

Figure 9:
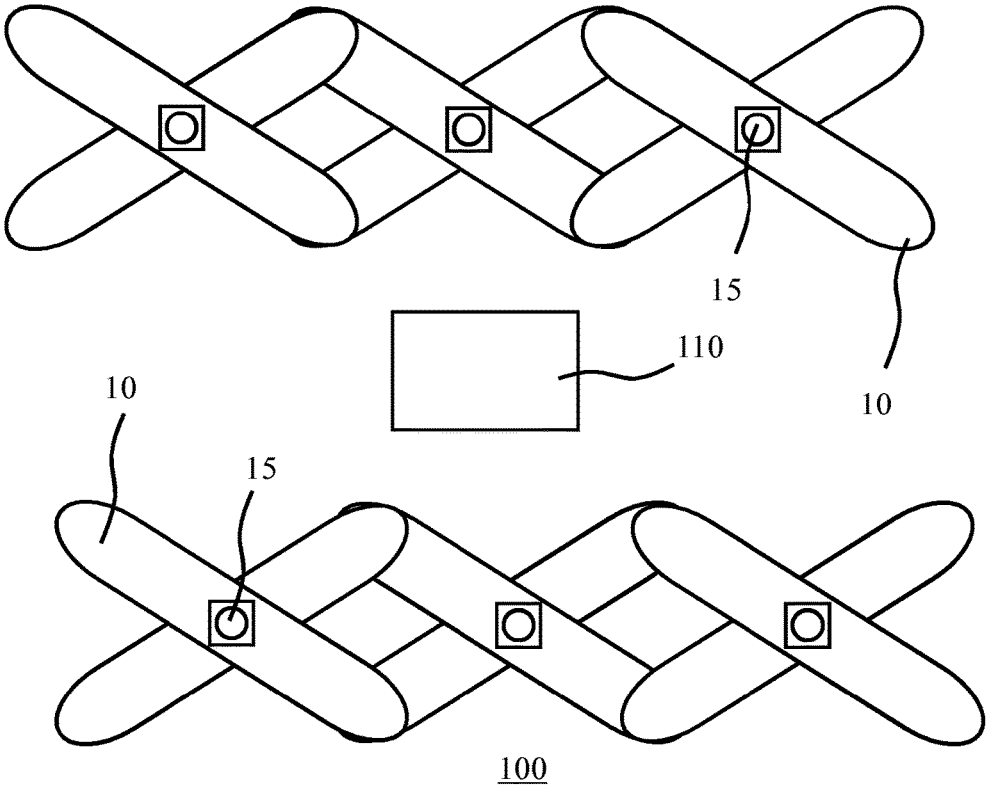
FIG. 9 schematically depicts a lighting system according to an embodiment.

FIG. 9 schematically depicts a lighting system 100 including a plurality of lighting devices 10 according to one or more embodiments of the present invention and a central controller 110. The lighting system 100 shown in FIG. 9 has two lighting devices 10 by way of non-limiting examples only; it should be understood that a lighting system 100 may have any suitable number of lighting devices 10.

The central controller 110 may comprise a user interface or may be adapted to communicate with a remote user interface in a wired or wireless manner, e.g. with a dedicated remote control or with a smart device such as a smart phone or tablet computer onto which a control application has been installed, in order to allow a user to operate the lighting devices 10 of the lighting system 100 in a desired manner, e.g. by selecting a pre-programmed program of the lighting system 100 or by programming the lighting system 100.

The central controller 110 is further adapted to control each of the lighting devices 10. To this end, the lighting devices 10 may be wired into the central controller 110 or may contain local controllers (not shown) adapted to communicate with the central controller 110 in any suitable manner, e.g. over a wired connection using a protocol such as DMX or DALI or over a wireless connection using a wireless communication protocol such as WiFi, Bluetooth or Zigbee. Other suitable communication protocols are of course equally feasible. The central controller 110 may be adapted to control each of the lighting devices 10 at any suitable level of granularity, e.g. by controlling all the respective point light sources, e.g. LEDs 15 of a lighting device 10 with a single control signal or by providing separate control signals for individual point light sources 15 or different groups of point light sources 15 within a lighting device 10.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising: a flexible arrangement including a chain of strips wherein respective end portions of neighboring strips are interconnected by a flexible join; and a plurality of point light sources positioned at regular intervals along the flexible arrangement, wherein the flexible arrangement comprises at least one elastic member for retaining the flexible arrangement in an equilibrium configuration in the absence of a stretching or compression force applied to the flexible arrangement; wherein the at least one elastic member returns the flexible arrangement to the equilibrium configuration once the applied force which forcibly changes the geometry of the flexible arrangement is no longer applied.

2. The lighting device of claim 1, wherein the flexible joins are hinging joints.

3. The lighting device of claim 2, wherein at least some of the point light sources are positioned on the hinging joints.

4. The lighting device of claim 1, wherein the flexible arrangement further comprises a further chain of strips wherein respective end portions of neighboring strips are interconnected by a flexible join, wherein at least some of the strips of the further chain are joined to a strip of the chain by a further flexible join in between the respective end portions of said strips.

5. The lighting device of claim 4, wherein each further flexible join is a further hinging joint located in a central region of said strips.

6. The lighting device of claim 5, wherein at least some of the point light sources are positioned on the further hinging joints.

7. The lighting device of claim 4, wherein at least some of the point light sources are positioned on an alternating pattern of hinging joints.

8. The lighting device of claim 1, wherein the point light sources are located on opposite surfaces of the lighting device.

9. The lighting device of claim 1, wherein the at least one elastic member comprises a plurality of springs interconnecting central regions of neighboring strips.

10. The lighting device of claim 1, wherein the at least one elastic member comprises an elastic material onto which the flexible arrangement is mounted or in which the flexible arrangement is embedded.

11. The lighting device of claim 10, wherein the elastic material is an elastic sheet covering the flexible arrangement and comprising a plurality of light exit structures, each light exit structure exposing one of the point light sources.

12. The lighting device of claim 11, wherein the flexible joins are flexible wires.

13. The lighting device of claim 1, wherein the point light sources are LEDs.

14. A lighting system comprising a plurality of the lighting devices of claim 1 and a central controller communicatively coupled to the plurality of lighting devices.

15. The lighting device of claim 13, wherein at least some of the LEDs are arranged to selectively generate white light or colored light.

* * * * *